US010021471B2

(12) United States Patent
Akino

(10) Patent No.: US 10,021,471 B2
(45) Date of Patent: Jul. 10, 2018

(54) ACOUSTIC TUBE AND NARROW DIRECTIONAL MICROPHONE USING THE SAME

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 15/384,921

(22) Filed: Dec. 20, 2016

(65) Prior Publication Data

US 2017/0188125 A1 Jun. 29, 2017

(30) Foreign Application Priority Data

Dec. 25, 2015 (JP) ..... 2015-252874

(51) Int. Cl.

| | |
|---|---|
| ***H04R 1/20*** | (2006.01) |
| ***H04R 1/08*** | (2006.01) |
| ***H04R 1/04*** | (2006.01) |
| ***H04R 1/32*** | (2006.01) |

(52) U.S. Cl.

CPC ..... *H04R 1/083* (2013.01); *H04R 1/04* (2013.01); *H04R 1/326* (2013.01)

(58) Field of Classification Search

CPC ..... H04R 29/004; H04R 1/02; H04R 1/021; H04R 1/028; H04R 1/04; H04R 1/08; H04R 1/34; H04R 1/342; H04R 3/04; H04R 31/006; H04R 2410/07; H04R 9/08; H04R 19/04; H04R 1/083; H04R 1/326; H04R 1/105; H04R 1/2807; H04R 2201/10; H04R 5/0335; H04R 1/20

USPC ..... 381/361, 122, 156.338, 374, 382, 381/111–117, 319, 92; 181/22, 196–199, 181/205, 202; 84/57; 700/94

See application file for complete search history.

(56) References Cited

U.S. PATENT DOCUMENTS

| | | | | |
|---|---|---|---|---|
| 2006/0002575 | A1* | 1/2006 | Akino | H04R 3/06 381/361 |
| 2006/0115099 | A1* | 6/2006 | Akino | H04R 1/04 381/113 |
| 2013/0034256 | A1* | 2/2013 | Akino | H04R 9/08 381/356 |

FOREIGN PATENT DOCUMENTS

JP 2562295 B2 12/1996

* cited by examiner

*Primary Examiner* — Leshui Zhang
(74) *Attorney, Agent, or Firm* — Manabu Kanesaka

(57) ABSTRACT

To prevent penetration of water into a microphone unit side even if the rain falls on a cylindrical acoustic tube in a narrow directional microphone using the acoustic tube. The narrow directional microphone includes a cylindrical acoustic tube base portion, the acoustic tube base portion includes at least one slit-like opening extending along a longitudinal direction of the acoustic tube base portion, a plurality of short fibers are implanted in an outer peripheral surface of the acoustic tube base portion and base portion edge surfaces that form the opening, and the opening is covered with the short fibers.

7 Claims, 5 Drawing Sheets

ACOUSTIC TUBE AND NARROW DIRECTIONAL MICROPHONE USING THE SAME

RELATED APPLICATIONS

The present application is based on, and claims priority from, Japanese Application No. JP2015-252874 filed Dec. 25, 2015, the disclosure of which is hereby incorporated by reference herein in its entirety.

BACKGROUND OF THE INVENTION

Field of the Invention

The present invention relates to an acoustic tube and a narrow directional microphone using the acoustic tube, and more particularly relates to an acoustic tube that can prevent intrusion of water and a narrow directional microphone using the acoustic tube.

Description of the Related Art

In narrow directional microphones having an acoustic tube, the acoustic tube is joined to a front portion of a microphone unit, and the joint portion is sealed so as to prevent sound waves penetrating into an inside through the joint portion. Such a configuration realizes narrow directivity but causes to increase an influence of wind noise, and an influence of proximity effect when a sound source is close.

To solve the problem, the applicant of the present application discloses, in Japanese Patent No. 2562295B2, a configuration in which a plurality of openings (sound wave introduction ports) is provided in a tube wall of an acoustic tube (made of aluminum) that accommodates a microphone unit, and an acoustic resistor (fabric, non-woven fabric, or the like) is affixed to portions outside the openings.

According to the configuration disclosed in the above document, influence of the wind noise and the proximity effect can be reduced compared with the conventional narrow directional microphones.

By the way, the narrow directional microphones as described above are often used outdoors because the microphones can eliminate ambient noise and can collect sounds of a target sound source.

However, as disclosed in the above document, the structure having the plurality of openings in the tube wall of the acoustic tube has a problem that, if the acoustic tube gets wet because of rain, for example, water infiltrates into the acoustic resistance material affixed to the openings of the tube wall, and the water penetrates into an interior of the acoustic tube, which may be a cause of breakdown of the microphone unit.

SUMMARY OF THE INVENTION

The present invention has been made in view of the foregoing, and an objective is to provide, in a narrow directional microphone using an acoustic tube, an acoustic tube that can prevent penetration of water into an accommodation space of a microphone unit even if the acoustic tube gets wet in the rain or the like, and a narrow directional microphone using the acoustic tube.

In order to solve the above problem, an acoustic tube according to an embodiment of the present invention includes a cylindrical acoustic tube base portion, wherein the acoustic tube base portion includes at least one slit-like opening formed along a longitudinal direction of the acoustic tube base portion, a plurality of short fibers are implanted in an outer peripheral surface of the acoustic tube base portion and base portion edge surfaces that form the opening, and the opening is covered with the short fibers.

The acoustic tube base portion is preferably dividable into a plurality of base portion parts by a division line along the longitudinal direction of the acoustic tube, the plurality of short fibers are preferably implanted on outer peripheral surfaces of the base portion parts and the base portion edge surfaces along the division line. A plurality of the slit-like openings covered with the short fibers is preferably formed, by facing the base portion edge surfaces of the plurality of base portion parts.

According to such a configuration, the slit-like openings along the longitudinal direction of the acoustic tube are formed in the acoustic tube, and the short fibers covering the opening function as an acoustic resistance material. Further, the plurality of short fibers are implanted in the outer peripheral surface of the acoustic tube, and thus the acoustic tube can repel the water on the outer peripheral surface. Further, the opening is covered with the short fibers, and thus the acoustic tube can prevent penetration of the water into an interior of the acoustic tube.

In order to solve the above problem, a narrow directional microphone according to an embodiment of the present invention includes: a microphone unit that performs sound collection; the above described acoustic tube having the microphone unit mounted at a rear end; and a cylindrical casing tube, having a plurality of openings formed in a peripheral surface, for accommodating the acoustic tube, wherein a locking member that fixes the acoustic tube in the casing tube is provided between the casing tube and the acoustic tube.

The locking member is preferably provided between one end portion of the casing tube and one end portion of the acoustic tube.

According to such a configuration, the acoustic tube is inserted into the casing tube, and the locking member is provided between the casing tube and the acoustic tube, so that the short fibers that cover the opening are compressed, and acoustic resistance in the opening becomes adjustable according to compressive strength.

Further, the locking member is provided between the casing tube and the acoustic tube at the one end portion of the casing tube, so that the size of the clearance (the magnitude of the acoustic resistance) of the opening varies gradually from one end toward the other end of the acoustic tube. Accordingly, the acoustic tube can be used as a horn having a diameter increasing along the direction from one end to the other end.

DESCRIPTION OF THE PREFERRED EMBODIMENTS

Figure 1A:
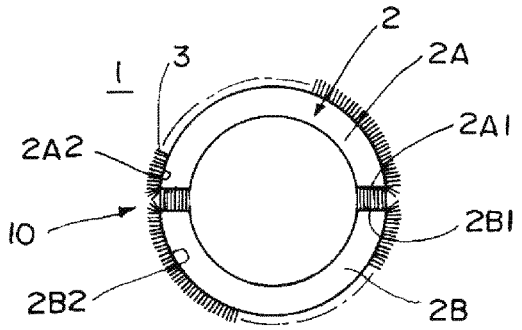
FIG. 1A is a sectional view of an acoustic tube according to the present invention in a short direction.

Hereinafter, an embodiment of the present invention will be described with reference to the drawings. FIG. 1A is a sectional view of an acoustic tube according to the present invention in a short direction, and FIG. 1B is a sectional view of the acoustic tube in a longitudinal direction.

Note that the illustrated acoustic tube has a rear end connected to a front acoustic terminal side of a microphone unit 100 (illustrated in FIG. 4), and is used in cooperation with the microphone unit 100 to exhibit narrow directivity, thereby to constitute a narrow directional microphone.

Figure 1B:
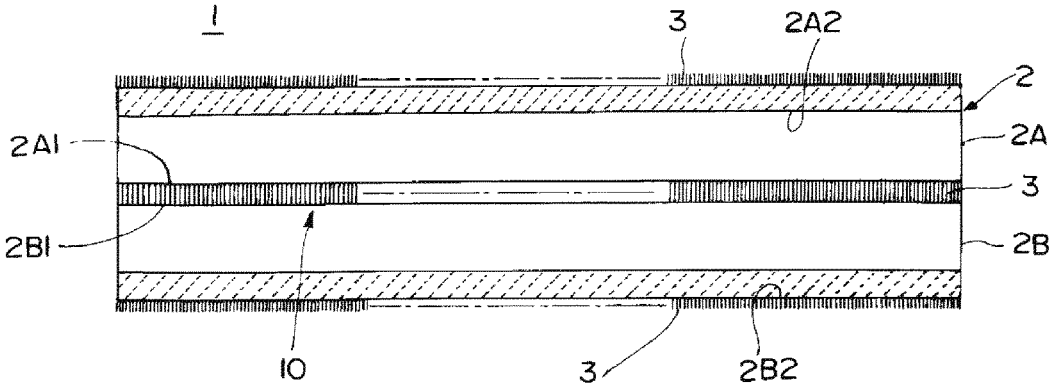
FIG. 1B is a sectional view of the acoustic tube in a longitudinal direction.

As illustrated in FIGS. 1A and 1B, an acoustic tube 1 includes a long cylindrical acoustic tube base portion 2 formed of plastic material, for example. A plurality of short fibers (piles) are implanted in an outer peripheral surface of the acoustic tube base portion 2.

To be specific, the acoustic tube base portion 2 is divided into two parts by a division line along a longitudinal direction of the acoustic tube, as illustrated in FIG. 1B, and is made of a base portion part 2A and a base portion part 2B. The divided two base portion parts 2A and 2B form a cylindrical shape by bringing divided surfaces 2A1 and 2B1 (base portion edge surfaces along the division line) to face each other. Short fibers (piles) 3 are implanted in outer peripheral surfaces 2A2 and 2B2 and the divided surfaces 2A1 and 2B1 of the base portion part 2A and the base portion part 2B. Slit-like openings 10 mutually covered with the short fibers 3 are formed (two openings 10 are formed at right and left both sides) in portions where the divided surfaces 2A1 and 2B1 are brought to face each other. The short fibers 3 provided on the openings 10 function as an acoustic resistance material.

Figure 2A:
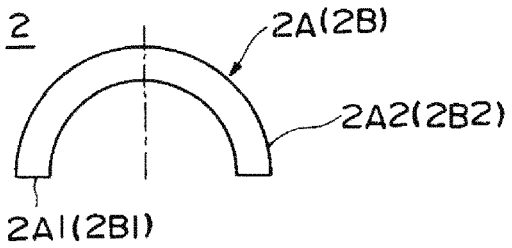
FIG. 2A is a sectional view of a base portion part that constitutes the acoustic tube of FIG. 1 in the short direction.
Figure 2B:
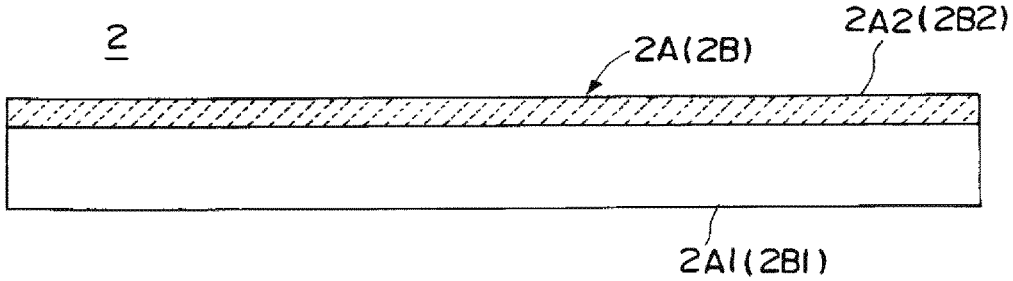
FIG. 2B is a sectional view of the base portion part in the longitudinal direction.

A procedure to manufacture the acoustic tube 1 will be described. The base portion part 2A (2B) having the cross sections illustrated in FIG. 2A and FIG. 2B is formed.

Next, a plurality of the short fibers (piles) 3 are provided in the outer surface 2A2 (2B2) and the divided surface 2A1 (2B1) of the base portion part 2A (2B) by means of electrostatic flocking.

The electrostatic flocking is performed in the following procedure, for example. An adhesive is coated in advance to a target surface of the base portion part 2A (2B) where implantation is required. The short fibers 3 to be implanted (affixed) are arranged on an electrode plate (not shown), and a high DC voltage is applied between the target surface and the electrode plate.

When an anode (plus) potential is applied to the target surface and a cathode (minus) potential is applied to the electrode plate, for example, polarization occurs in the short fibers 3. The short fibers 3 charged with the minus electric charge are attracted to and implanted in the target surface. That is, as illustrated in the sectional view in the short direction of FIG. 3A, and the sectional view in the longitudinal direction of FIG. 3B, an implanted state of the short fibers 3 is mechanically held by curing of the adhesive.

By use of the electrostatic flocking means, an apex portion of the implanted short fiber 3 is positively charged, and thus the apex portions of the short fibers 3 have the same polarity and repel each other. Accordingly, the short fibers 3 are implanted to vertically rise with respect to the implantation surface.

Note that the length of the short fibers 3 is favorably 0.2 to 2 mm. Further, as the material of the short fibers 3, rayon fiber, polyamide fiber, and polyester fiber may be favorably used.

Figure 3A:
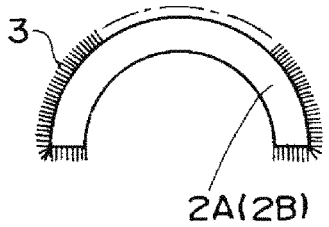
FIG. 3A is sectional view of the base portion part that constitutes the acoustic tube of FIG. 1 in a state where short fibers are implanted in the base portion part.
Figure 3B:
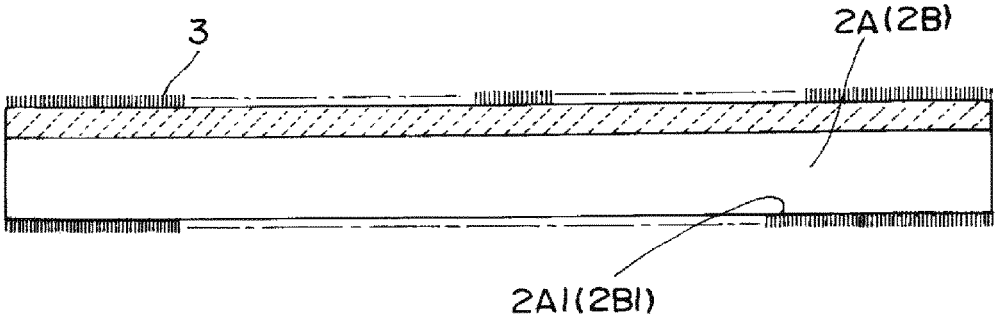
FIG. 3B is a sectional view of the base portion part in the longitudinal direction.

In this way, the base portion parts 2A and 2B as illustrated in FIGS. 3A and 3B are formed, and the respective divided surfaces 2A1 and 2B1 are combined across the short fibers 3, as illustrated in FIG. 1. Accordingly, the cylindrical acoustic tube 1 is completed.

According to the acoustic tube 1, the short fibers (piles) 3 are implanted in the outer peripheral surface, and thus even if raindrops, for example, fall on the outer peripheral surface, the outer peripheral surface can repel the water. Further, the openings 10 are covered with the short fibers (piles) 3, and thus penetration of water into an interior of the acoustic tube 1 through the openings 10 can be prevented.

Further, since the acoustic tube 1 is formed by a simple combination of the two base portion parts 2A and 2B, as described above, means to fix the parts is necessary.

Figure 4:
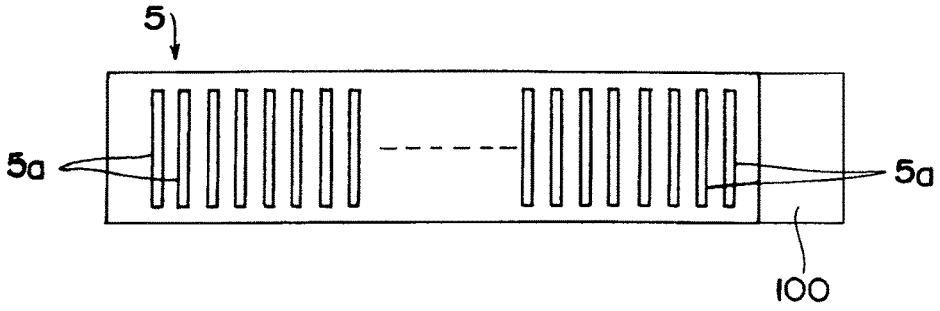
FIG. 4 is a side view of a casing tube that can accommodate the acoustic tube of FIG. 1.

In the present embodiment, as the fixing means, a casing tube 5 as illustrated in FIG. 4 is used. This casing tube 5 is a plastic-made cylindrical tube that can accommodate the acoustic tube 1, and a plurality of openings 5*a* are formed in a peripheral surface along the longitudinal direction of the casing tube 5.

Figure 5:
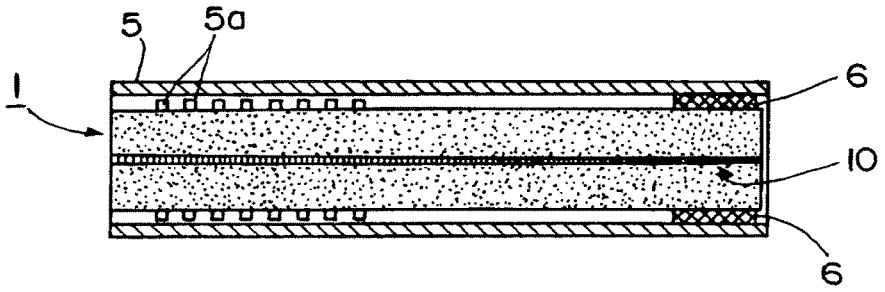
FIG. 5 is a sectional view of the casing tube in a state where the casing tube accommodates the acoustic tube of FIG. 1, in the longitudinal direction.
Figure 6:
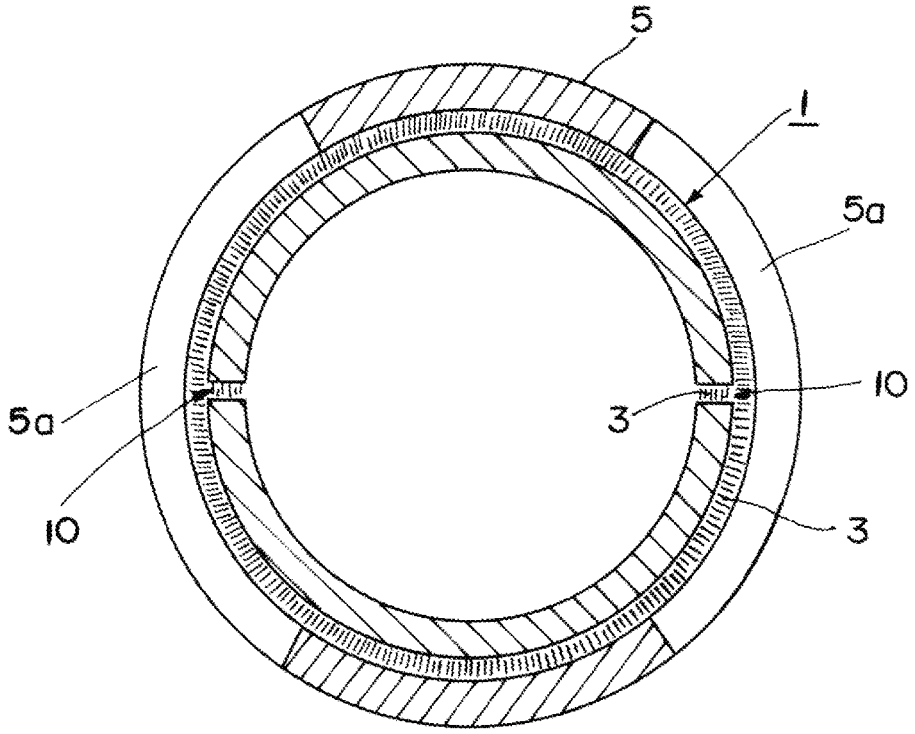
FIG. 6 is a sectional view of the casing tube in a state where the casing tube accommodates the acoustic tube of FIG. 1, in the short direction.

When the acoustic tube 1 is inserted into the casing tube 5, the base portion parts 2A and 2B are simply integrated. In this state, the acoustic tube 1 may not be fixed in the casing tube 5. Therefore, in the present embodiment, a spacer (locking member) 6 is arranged between the casing tube 5 and the acoustic tube 1, as illustrated in FIG. 5. This spacer 6 may or may not have a cylindrical shape. A plurality of the spacers 6 may be partially arranged so that pressing force is applied to at least a direction into which the base portion parts 2A and 2B closely come close to each other. The spacer 6 does not only fix the acoustic tube 1 to the interior of the casing tube 5 but also compress the short fibers 3 that cover the openings 10. Therefore, by changing compressive strength (pressing force) of the spacer 6, the spacer 6 enables adjustment of the acoustic resistance in the openings 10. Further, the magnitude of the acoustic resistance can be adjusted, and thus a directional angle of sound collection can be changed.

Note that, as the material of the spacer 6, such as polycarbonate, ABS may be used.

As illustrated in FIG. 5, the spacer 6 is provided only at one end portion in the casing tube 5, so that spacing of the openings 10 where the base portion parts 2A and 2B of the acoustic tube 1 are brought to face each other gradually increases from one end toward the other end of the acoustic tube 1. Accordingly, the magnitude of the acoustic resistance can be gradually reduced from the one end portion toward the other end portion of the acoustic tube 1, and the acoustic tube 1 can be used like a horn.

Note that the plurality of openings 5*a* are formed in the casing tube 5, as described above, and thus an influence of the casing tube 5 on the sound collection is remarkably decreased.

Further, even if the water penetrates through the openings 5*a* in the casing tube 5, the water is repelled at the outer surface of the acoustic tube 1 and is drained through the openings 5*a*. Therefore, the water does not accumulate in the casing tube 5.

According to the embodiment of the present invention, the acoustic tube 1 (acoustic tube base portion 2) is divided into the two base portion parts 2A and 2B, so that the slit-like openings 10 along the longitudinal direction of the acoustic tube 1 are formed. The short fibers 3 that cover the openings 10 function as the acoustic resistance material. Further, the plurality of short fibers 3 are implanted in the outer peripheral surface of the acoustic tube 1, and thus the acoustic tube in the present embodiment repels the water on the outer peripheral surface, and further, the openings 10 are covered with the short fibers 3, and thus prevent penetration of the water into the interior of the acoustic tube 1.

Further, the acoustic tube 1 is configured such that the two base portion parts 2A and 2B are inserted into the casing tube 5, and is fixed in the casing tube 5 by the locking member 6 provided between the casing tube 5 and the acoustic tube 1 at the one end portion of the casing tube 5.

Accordingly, the size of the openings 10 (the magnitude of the acoustic resistance) is gradually changed from the one end toward the other end of the acoustic tube 1. Therefore, the acoustic tube 1 functions like a horn with a diameter increasing toward the other end.

Note that, in the embodiment, the two slit-like openings 10 along the longitudinal direction of the acoustic tube 1 are formed by dividing the acoustic tube 1 into two parts. However, the form is not limited to the embodiment in the present invention.

For example, three or more slit-like openings 10 may be formed by the acoustic tube 1 divided into three or more parts.

Alternatively, the acoustic tube 1 is not divided, and one slit-like opening 10 may be formed along the longitudinal direction of the acoustic tube 1.

Further, in the embodiment, the spacer 6 is provided between the casing tube 5 and the acoustic tube 1 at the one end portion of the casing tube 5. However, in the present invention, the form of the spacer 6 is not limited to the embodiment.

For example, the acoustic tube 1 may be configured such that the spacer 6 is provided between the casing tube 5 and the acoustic tube 1 near the center of the casing tube 5, or on both ends of the casing tube 5, and as a result, the short fibers 3 can be approximately uniformly compressed.

What is claimed is:

1. An acoustic tube comprising:

a cylindrical acoustic tube base portion including at least one slit opening formed along a longitudinal direction of the cylindrical acoustic tube base portion, and edge surfaces arranged apart from each other to form the at least one slit openings therebetween; and a plurality of short fibers implanted on an outer peripheral surface and the edge surfaces of the cylindrical acoustic tube base portion, the at least one slit opening being covered with the plurality of short fibers implanted on the edge surfaces of the cylindrical acoustic tube base portion, wherein the at least one slit opening has a width in the longitudinal direction of the cylindrical acoustic tube base portion gradually increasing from one end of the cylindrical acoustic tube base portion toward another end thereof.

2. The acoustic tube according to claim 1, wherein the cylindrical acoustic tube base portion is divided into a plurality of base portion parts along the longitudinal direction of the cylindrical acoustic tube base portion, the plurality of short fibers is implanted on outer peripheral surfaces of the plurality of base portion parts and edge surfaces of the plurality of base portion parts, and the at least one slit opening includes a plurality of slit openings, each being covered with the plurality of short fibers implanted on the edge surfaces of the plurality of base portion parts facing each other.

3. A narrow directional microphone comprising:

a microphone unit that performs sound collection;

the acoustic tube according to claim 1, that allows the microphone unit to be mounted at a rear end of the acoustic tube;

a cylindrical casing tube having a plurality of openings formed in a peripheral surface of the cylindrical casing tube, and accommodating the acoustic tube therein; and a locking member that fixes the acoustic tube in the cylindrical casing tube, and that is arranged between one end portion of the cylindrical casing tube and one end portion of the acoustic tube such that with a pressing force of the locking member to the acoustic tube, the width of the at least one slit opening gradually increases from the one end of the cylindrical acoustic tube base portion toward the another end thereof.

4. A narrow directional microphone comprising:

a microphone unit that performs sound collection;

the acoustic tube according to claim 2, that allows the microphone unit to be mounted at a rear end of the acoustic tube;

a cylindrical casing tube having a plurality of openings formed in a peripheral surface of the cylindrical casing tube, and accommodating the acoustic tube therein; and a locking member that fixes the acoustic tube in the cylindrical casing tube, and that is arranged between one end portion of the cylindrical casing tube and one end portion of the acoustic tube such that with a pressing force of the locking member to the acoustic tube, the width of the at least one slit opening gradually increases from the one end of the cylindrical acoustic tube base portion toward the another end thereof.

5. The acoustic tube according to claim 1, wherein the cylindrical acoustic tube base portion is divided into two base portion parts separately formed from and arranged apart from each other, each of the two base portion parts having two edge surfaces at two ends thereof, and the at least one slit opening includes two slit openings, each of the two slit openings continuously extending from the one end of the cylindrical acoustic tube base portion to the another end thereof, and being formed between the two edge surfaces facing each other.

6. An acoustic tube comprising:

a cylindrical acoustic tube base portion including a plurality of base portion parts separately formed from and spaced from each other, and a plurality of slit openings formed between two of the plurality of base portion parts and extending along a longitudinal direction of the cylindrical acoustic tube base portion, each of the plurality of base portion parts having edge surfaces to form the slit openings therebetween; and a plurality of short fibers implanted on an outer peripheral surface and the edge surfaces of the base portion parts, the plurality of slit openings being covered with the plurality of short fibers implanted on the edge surfaces of the cylindrical acoustic tube base portion.

7. An acoustic tube apparatus comprising:

the acoustic tube according to claim 6; and a case in which the cylindrical acoustic tube is stored, wherein in the case, the plurality of base portion is fixed and is arranged at intervals to form the at least one slit opening therebetween.

* * * * *